US005769664A

United States Patent [19]

Saito et al.

[11] Patent Number: 5,769,664

[45] Date of Patent: Jun. 23, 1998

[54] MECHANISM FOR DETECTING HALF-INSERTION OF A TERMINAL FOR A CONNECTOR

[75] Inventors: Hitoshi Saito; Hisashi Tsukamoto, both of Shizuoka, Japan

[73] Assignee: Yazaki Corporation, Tokyo, Japan

[21] Appl. No.: 632,324

[22] Filed: Apr. 17, 1996

[30] Foreign Application Priority Data

Apr. 17, 1995 [JP] Japan ..... 7-090968

[51] Int. Cl.[6] ..... H01R 13/514

[52] U.S. Cl. ..... 439/595; 439/752

[58] Field of Search ..... 439/595, 752

[56] References Cited

U.S. PATENT DOCUMENTS

| | | | |
|---|---|---|---|
| 5,322,456 | 6/1994 | Yagi et al. | 439/595 |
| 5,397,249 | 3/1995 | Endo et al. | 439/595 |
| 5,520,553 | 5/1996 | Cecil, Jr. et al. | 439/595 |
| 5,525,077 | 6/1996 | Badaroux | 439/595 |
| 5,575,683 | 11/1996 | Saito et al. | 439/595 |
| 5,575,684 | 11/1996 | Uchida et al. | 439/595 |

FOREIGN PATENT DOCUMENTS

| | | | |
|---|---|---|---|
| 61-7875 | 1/1986 | Japan | H01R 13/422 |
| 5-190229 | 7/1993 | Japan | H01R 13/42 |

*Primary Examiner*—J. J. Swann

*Attorney, Agent, or Firm*—Sughrue, Mion, Zinn, Macpeak & Seas, PLLC

[57] ABSTRACT

A mechanism for detecting whether a terminal of a connector is full-inserted or half-inserted into a terminal receiving chamber. A housing of the connector has a terminal receiving chamber into which a metal terminal is to be inserted, a flexible engagement arm projecting into the terminal receiving chamber and being designed engage to a metal terminal inserted into the terminal receiving chamber to thereby prevent disengagement of the metal terminal from the terminal receiving chamber, and a wall defining a deformation space between itself and the engagement arm, the engagement arm deformable in the deformation space. A front holder is to be inserted into the deformation space so as to prevent the metal terminal from being disengaged from the terminal receiving chamber, and has a half-insertion detector for detecting half-insertion of the metal terminal into the terminal receiving chamber. The wall includes an abutment surface to which the half-insertion detector abuts when the metal terminal is half-inserted into the terminal receiving chamber, the abutment surface being located closer to the deformation space than to a free end of the engagement arm. The wall further includes, at an inlet through which the front holder is to be inserted into the housing, an abutment surface guide for deforming the half-insertion detector towards the abutment surface.

8 Claims, 9 Drawing Sheets

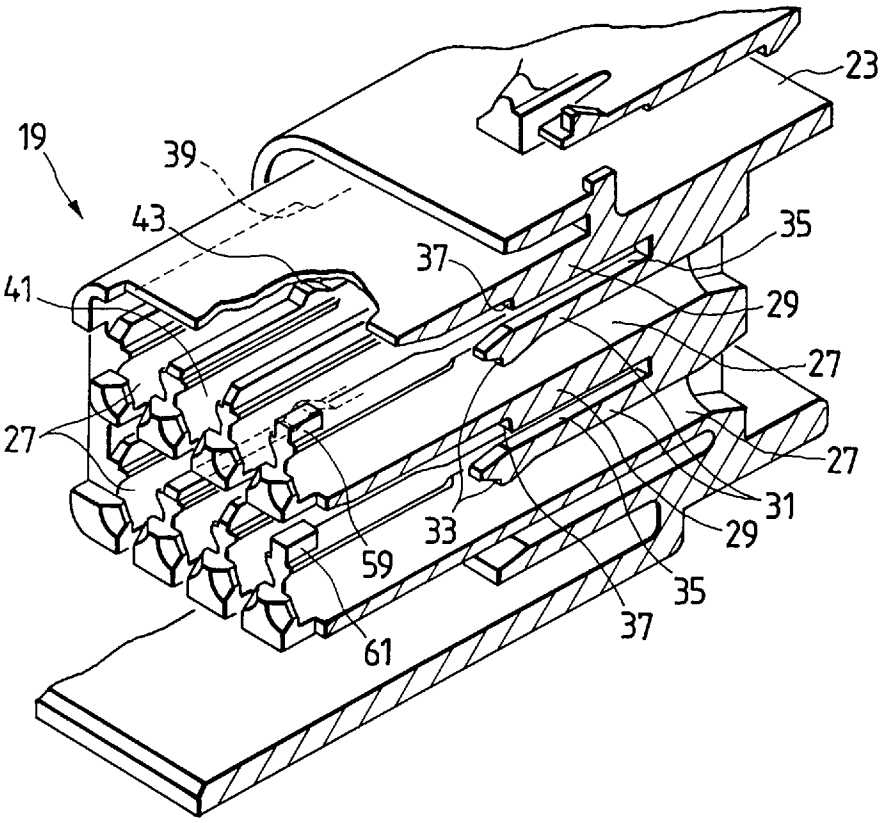
FIG. 3
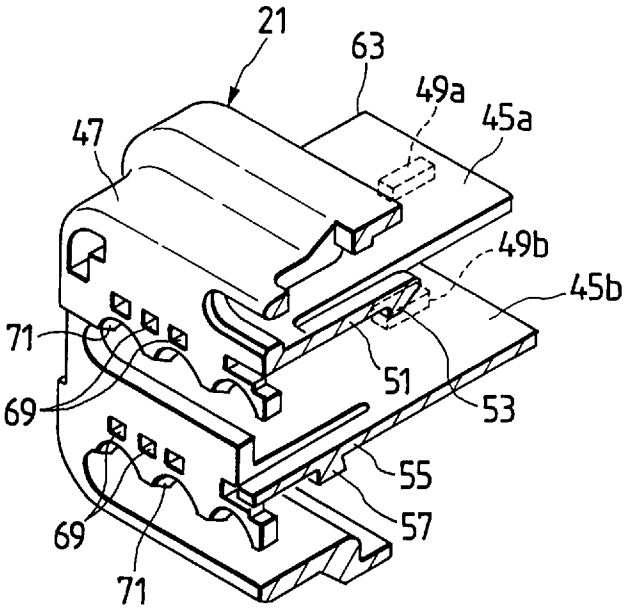

MECHANISM FOR DETECTING HALF-INSERTION OF A TERMINAL FOR A CONNECTOR

BACKGROUND OF THE INVENTION

1. Field of the Invention

The invention relates to a mechanism for detecting whether a terminal of a connector is full-inserted or half-inserted into a terminal receiving chamber.

2. Description of the Related Art

FIGS. 1 and 2 illustrate a connector 1 disclosed in Japanese Utility Model Unexamined Publication No. Sho. 61-7875. The connector 1 has a housing 3 in which terminal receiving chambers 5 are formed. Each of the terminal receiving chambers 5 is formed therein with a flexible engagement arm 7 having a stepped portion 9 to which a metal terminal 11 inserted into the terminal receiving chamber 5 is engaged.

The connector 1 also includes a front holder 13 secured to the housing 3 for dual engagement between the housing and the metal terminals. The front holder 13 has a detecting plate 17 to be inserted into a deformation space 15 of the engagement arms 7 through a front end of the connector 1 to thereby detect half-insertion of the metal terminals 11.

The metal terminals 11 are inserted into the terminal receiving chambers 5, each engaged with the engagement arm 7 so as to prevent disengagement of the metal terminals 11 from the connector. Then, the detecting plate 17 of the front holder 13 is inserted into the deformation space 15 through the front end of the connector 1. Thus, the flexible engagement arms 7 are not undesirably deformed, and hence the metal terminals 11 are doubly engaged to the housing 3 in the terminal receiving chambers 5 by the engagement arms 7 and the front holder 13.

When the metal terminals 11 are full-inserted into the terminal receiving chambers 5, the detecting plate 17 is inserted into the deformation space 15 of the engagement arms (see FIG. 1). Hence, it can be seen that the metal terminals 11 are not half-inserted into the terminal receiving chambers 5. On the other hand, when one of the metal terminals 11 is half-inserted into the terminal receiving chamber 5, the detecting plate 17 cannot be inserted into the deformation space 15, because the engagement arm 7 is in deformation (see FIG. 2). Thus, it can be readily determined that the metal terminal 11 is half-inserted into the terminal receiving chamber 5.

However, if the detecting plate 17 continues to be pushed while abutting against a front end of the engagement arm 7 when the metal terminal 11 is half-inserted into the terminal receiving chamber 5, the front end of the engagement arm 7 is likely to be damaged. As a result, the detecting plate 17 may enter the deformation space 15. In such a case, the front holder 13 may be secured to the housing 3 with the metal terminal 11 half-inserted into the terminal receiving chamber 5. Thus, there arises a problem that it is not always possible to detect whether the metal terminals 11 are full- or half-inserted into the terminal receiving chambers 5.

In addition, as the width of the engagement arms 7 is decreased, if the connector 1 is made smaller, the strength of the front end of the engagement arms 7 is also reduced. Thus, if the detecting plate 17 is forced into the deformation space 15, the detecting plate 17 is prone to be damaged, and accordingly, the accuracy of insertion detection is lowered.

SUMMARY OF THE INVENTION

It is an object of the present invention to provide a mechanism for detecting whether a metal terminal of a connector is full- or half-inserted into a terminal receiving chamber without damaging a flexible engagement arm.

In attaining the above object, the present invention provides a mechanism for detecting whether a metal terminal is half-inserted into a connector, the mechanism comprising: a housing including a terminal receiving chamber into which a metal terminal is to be inserted; a flexible engagement arm projecting into the terminal receiving chamber and being designed to engage to the metal terminal inserted into the terminal receiving chamber to thereby prevent disengagement of the metal terminal from the terminal receiving chamber; and a wall defining a deformation space between itself and the engagement arm, the engagement arm to be deformed in the deformation space; and a front holder which is to be inserted into the deformation space so as to prevent the metal terminal from being disengaged from the terminal receiving chamber, and which has a half-insertion detector for detecting half-insertion of the metal terminal into the terminal receiving chamber, the wall including an abutment surface to which the half-insertion detector abuts when the metal terminal is half-inserted into the terminal receiving chamber, the abutment surface being located closer to the deformation space than to a free end of the engagement arm, and the wall further including, at an inlet through which the front holder is to be inserted into the housing, abutment surface guide means for deforming the half-insertion detector towards the abutment surface.

BRIEF DESCRIPTION OF THE DRAWINGS

FIG. 3 is a perspective view illustrating a connector to which a mechanism according to the present invention is applied, with portions broken away for the sake of clarity;

DETAILED DESCRIPTION OF THE PREFERRED EMBODIMENT

A preferred embodiment of the present invention will be explained hereinbelow with reference to the drawings. FIG. 3 is a perspective view illustrating a connector 19 to which a mechanism according to the present invention is applied, and a front holder 21 to be secured to the connector 19 with portions broken away for the sake of clarity, FIG. 4 is a front view of a housing 23, FIG. 5 is a side view of the housing 23, FIGS. 6 and 7 are cross-sectional views of an inside of the housing 23, and FIG. 8 is a rear view of the housing 23.

Figure 1:
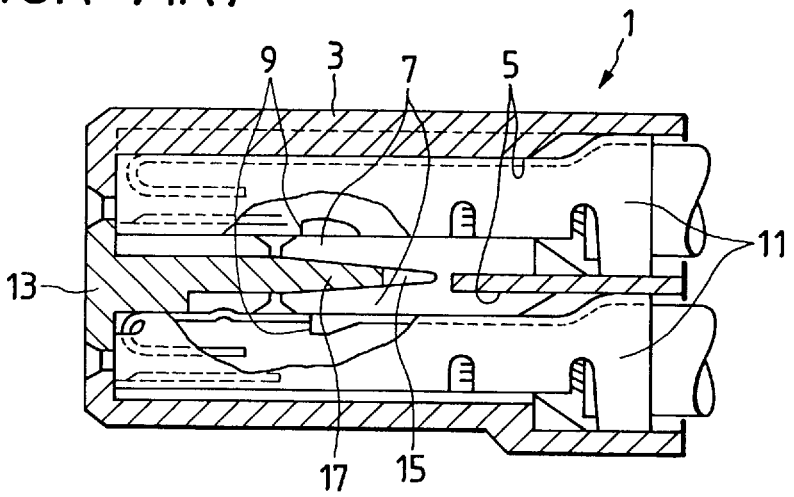
FIG. 1 PRIOR ART
FIG. 1 is a cross-sectional view of a conventional connector.
Figure 2:
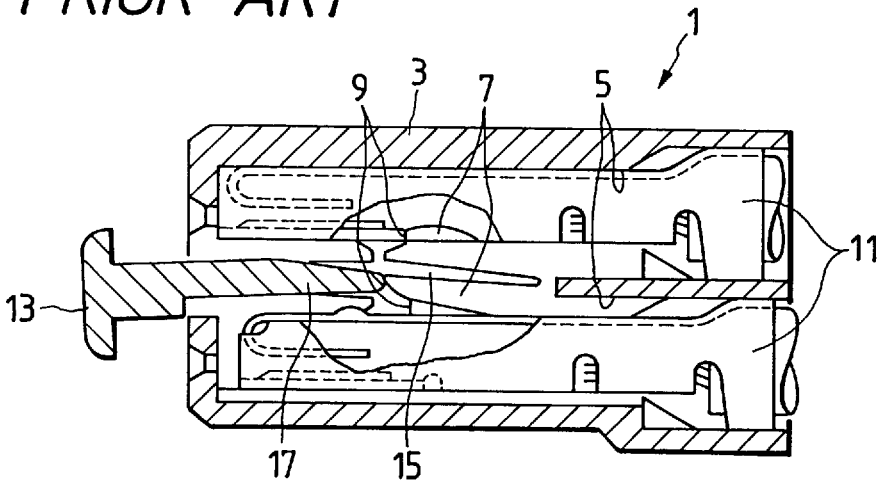
FIG. 2 PRIOR ART
FIG. 2 is a cross-sectional view of the conventional connector illustrated in FIG. 1 with a metal terminal being half-inserted into a terminal receiving chamber.
Figure 4:
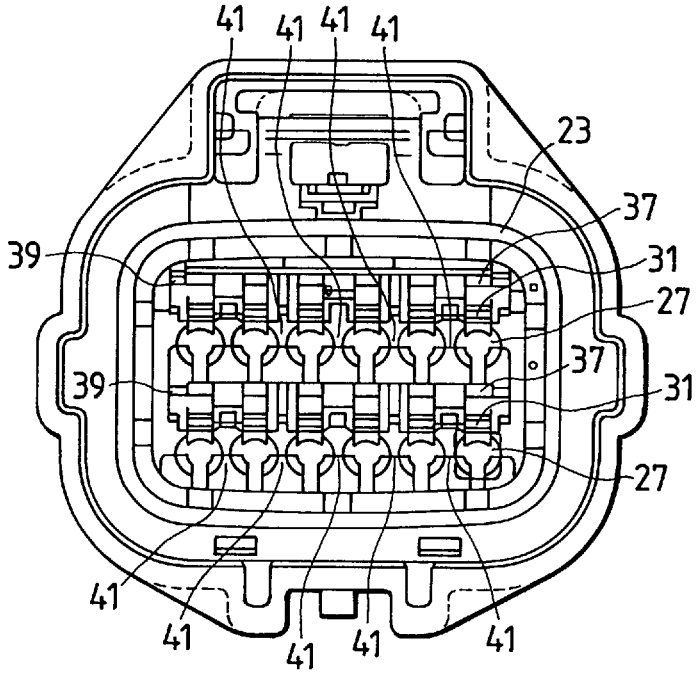
FIG. 4 is a front view of a housing.
Figure 5:
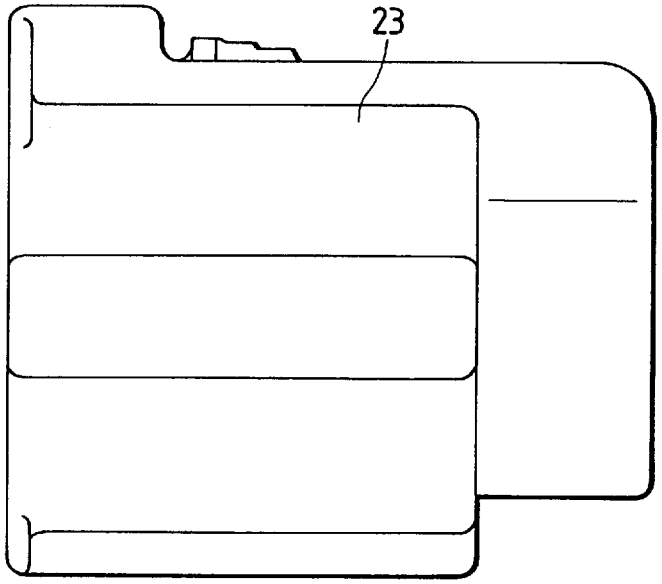
FIG. 5 is a side view of the housing illustrated in FIG. 4.
Figure 6:
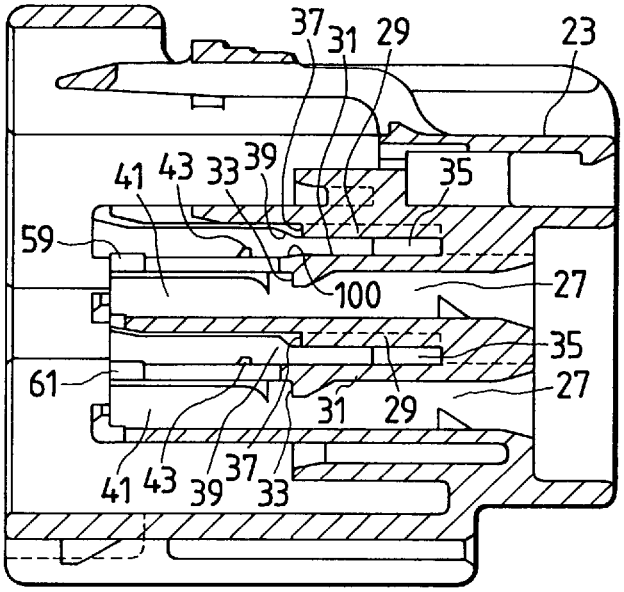
FIG. 6 is a side cross-sectional view of an inside of the housing illustrated in FIG. 4.
Figure 7:
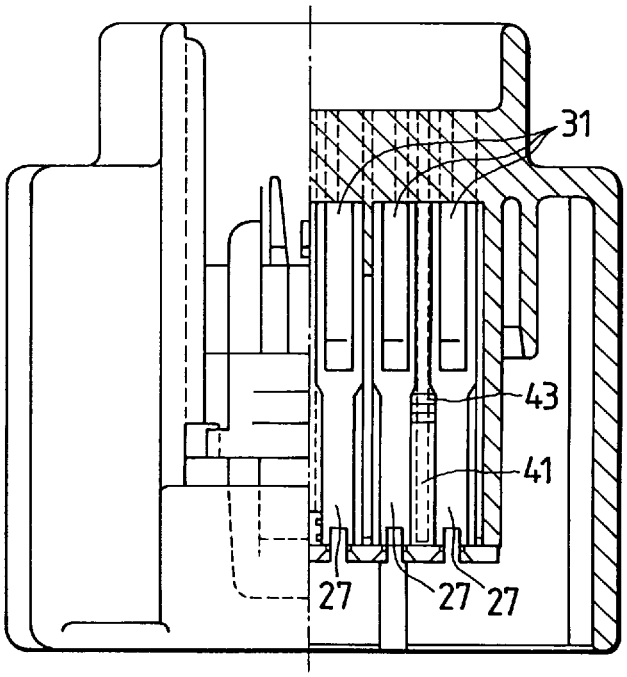
FIG. 7 is a partial cross-sectional top view of an inside of the housing illustrated in FIG. 4.

As illustrated in FIGS. 3 to 8, the connector 19 comprises the housing 23 and the front holder 21 to be secured to the housing 23. The housing 23 is formed with a plurality of terminal receiving chambers 27 in upper and lower stages. The terminal receiving chambers 27 are partitioned into individual chambers by vertical walls 41, and the terminal receiving chambers 27 are open at their upper sides to thereby be in communication with adjacent terminal receiving chambers. In addition, each of the terminal receiving chambers 27 is formed with a flexible engagement arm 31 extending from a wall 29 defining the terminal receiving chambers 27. Each of the engagement arms 31 is formed at a free end thereof with a stepped portion 33. There is formed a deformation space 35 between the wall 29 and the engagement arm 31. In addition, an abutment surface 37 is formed facing a front of the wall 29 through which the front holder 21 is to be inserted. The abutment surface 37 is formed in each of the adjacent terminal receiving chambers 27. When a metal terminal is half-inserted into the terminal receiving chamber 27, half-insertion detectors 45*a* and 45*b* (described later) of the front holder 21 abut the abutment surface 37. As illustrated in FIGS. 4 and 6, the abutment surface 37 is formed at opposite ends thereof with inclined surfaces 39.

Figure 8:
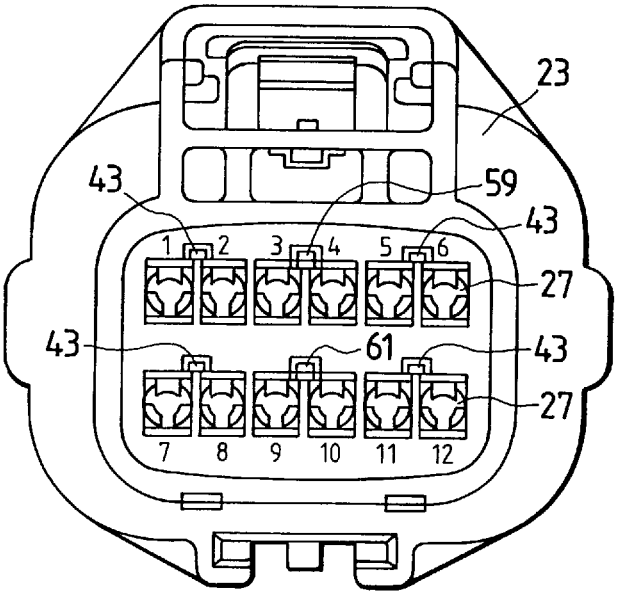
FIG. 8 is a rear view of the housing illustrated in FIG. 4 as viewed from a rear thereof.

Among a plurality of the vertical walls 41 by which the terminal receiving chambers 27 are partitioned, the vertical walls 41 located near outside walls of the housing are formed at upper ends thereof with push-up projections 43, as shown in FIGS. 3 and 8. The push-up projections 43 cause the half-insertion detectors 43*a* and 45*b* of the front holder 21 to deform towards the abutment surface 37.

As illustrated in FIGS. 9 to 13, a main body 47 of the front holder 21 is formed with the half-insertion detectors 45*a* and 45*b* extending therefrom. These half-insertion detectors 45*a* and 45*b* are to be inserted into the terminal receiving chambers 27 formed in the housing 23 in upper and lower stages. Each of the half-insertion detectors 45*a* and 45*b* is formed at a lower surface of a distal end thereof with a raised portion 49*a* and 49*b*, respectively. These raised portions 49*a* and 49*b* abut and slide on the push-up projections 43. The push-up projections 43 cooperate with the raised portions 49*a* and 49*b* to form an abutment surface guide means. In addition, opposite sides of the half-insertion detectors 45*a* and 45*b* define driving portions 63 which are to abut and slide on the inclined surfaces 39 formed at opposite sides of the abutment surface 37. The inclined surfaces 39 and the driving portions 63 cooperate with each other to form a deformation space guide means.

Figure 10:
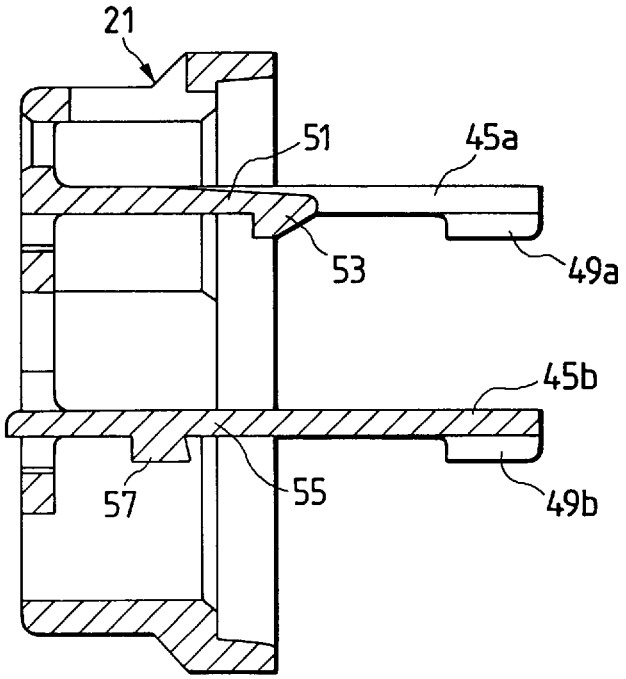
FIG. 10 is a side cross-sectional view of an inside of the front holder illustrated in FIG. 9.
Figure 11:
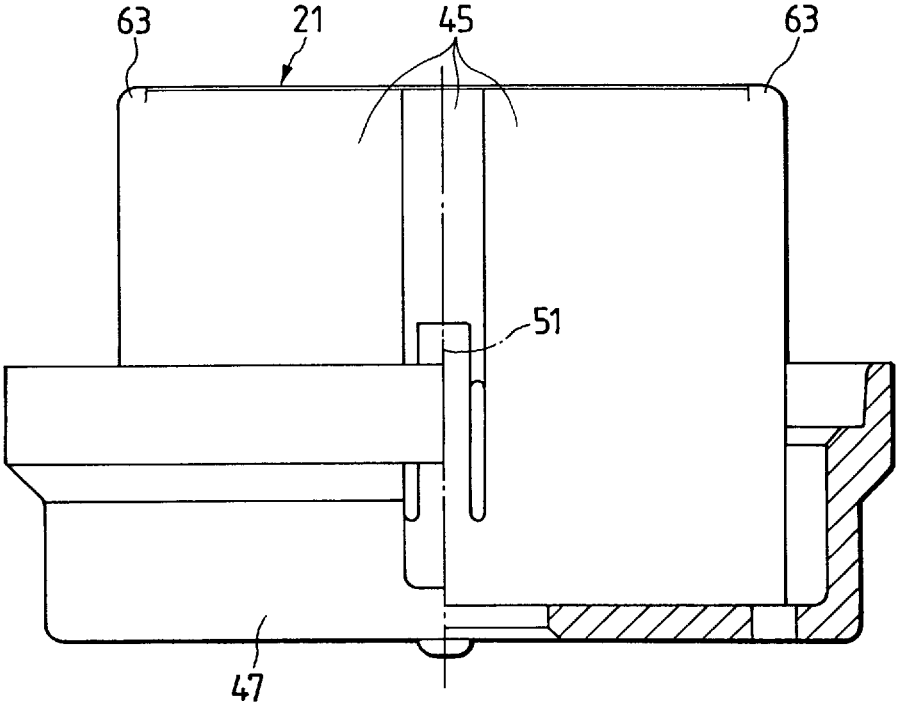
FIG. 11 is a partial cross-sectional top view of the front holder illustrated in FIG. 9.
Figure 12:
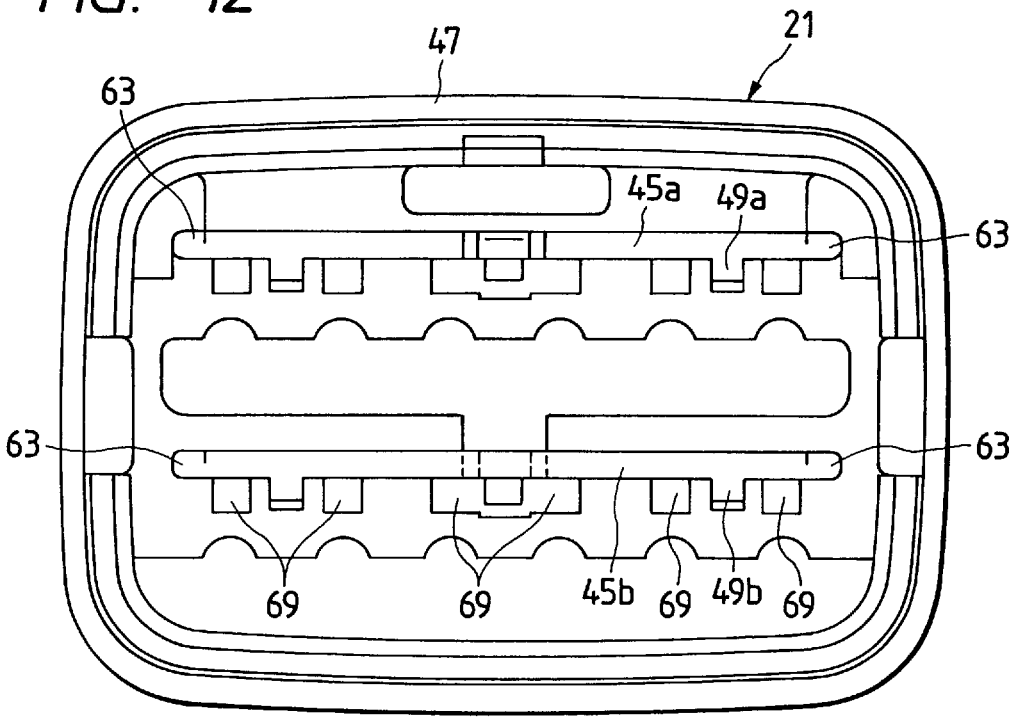
FIG. 12 is a rear view of the front holder illustrated in FIG. 9 as viewed from a rear thereof.
Figure 13:
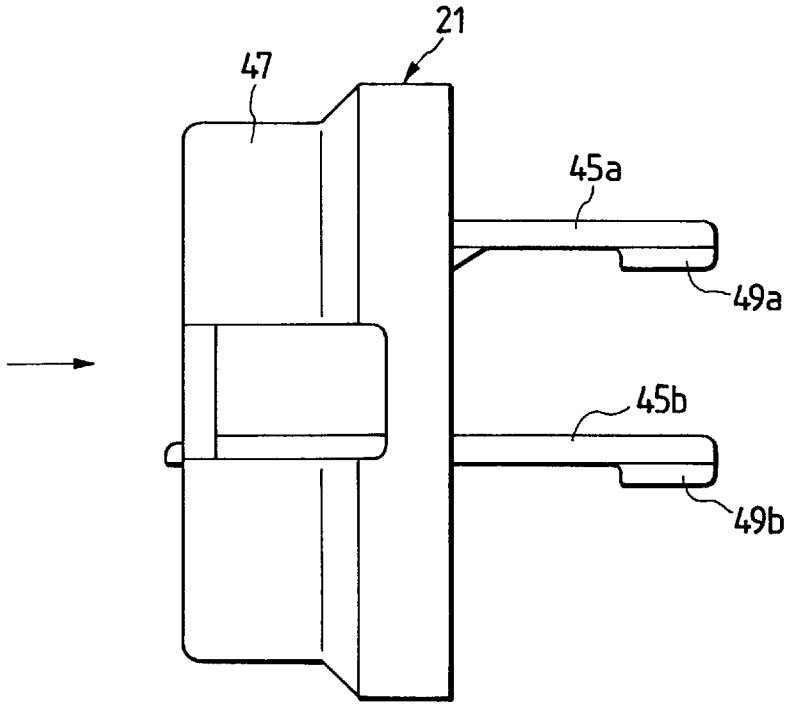
FIG. 13 is a side view of the front holder illustrated in FIG. 9.
Figure 14:
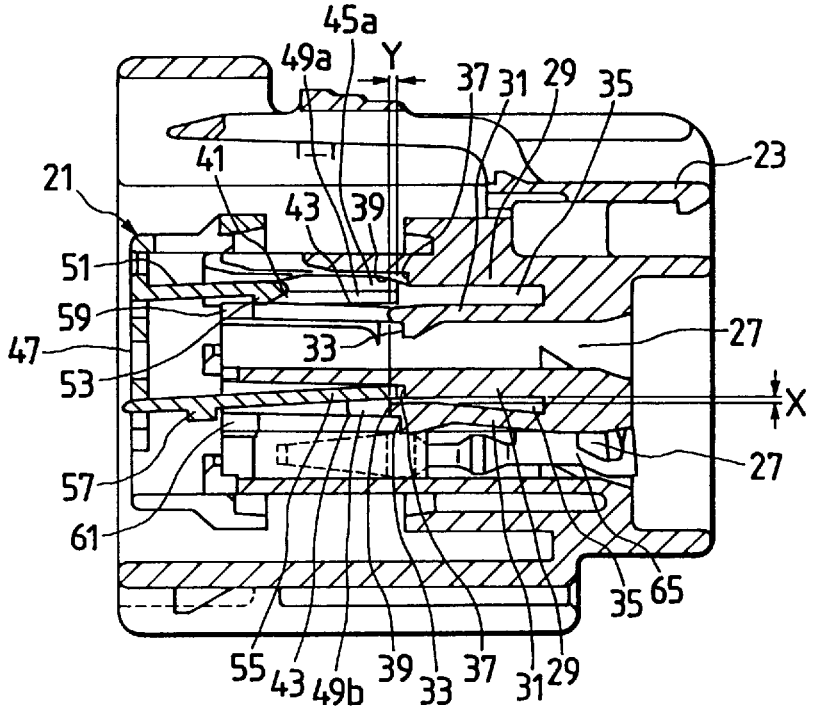
FIG. 14 is a cross-sectional view of the front holder assembled to the housing in a provisional engagement position.
Figure 15:
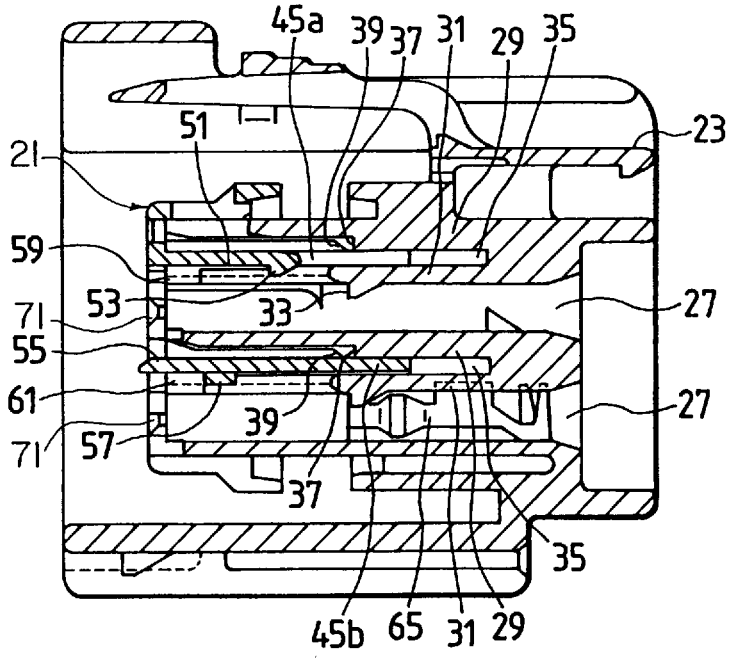
FIG. 15 is a cross-sectional view of the front holder assembled to the housing in a settled engagement position.

As illustrated in FIGS. 3 and 10, the upper half-insertion detector 45*a* is formed at an intermediate portion thereof with a flexible lock arm 51. The lock arm 51 is formed at a distal end thereof with a provisional engagement projection 53 directing towards the lower half-insertion detector 45*b*. Similarly, the lower half-insertion detector 45*b* is formed at an intermediate portion thereof with a lock arm 55. The lock arm 55 is formed at a lower surface thereof with a final engagement projection 57 extending therefrom and located closer to the main body 47 than the provisional engagement projection 53. As illustrated in FIGS. 14 and 15, the provisional engagement projection 53 and the final engagement projection 57 are to engage to projections 59 and 61, respectively, which extend from the walls partitioning the terminal receiving chambers 27, to thereby cause the front holder 21 to be engaged to the housing 23 at either a provisional engagement position or a final engagement position.

Figure 9:
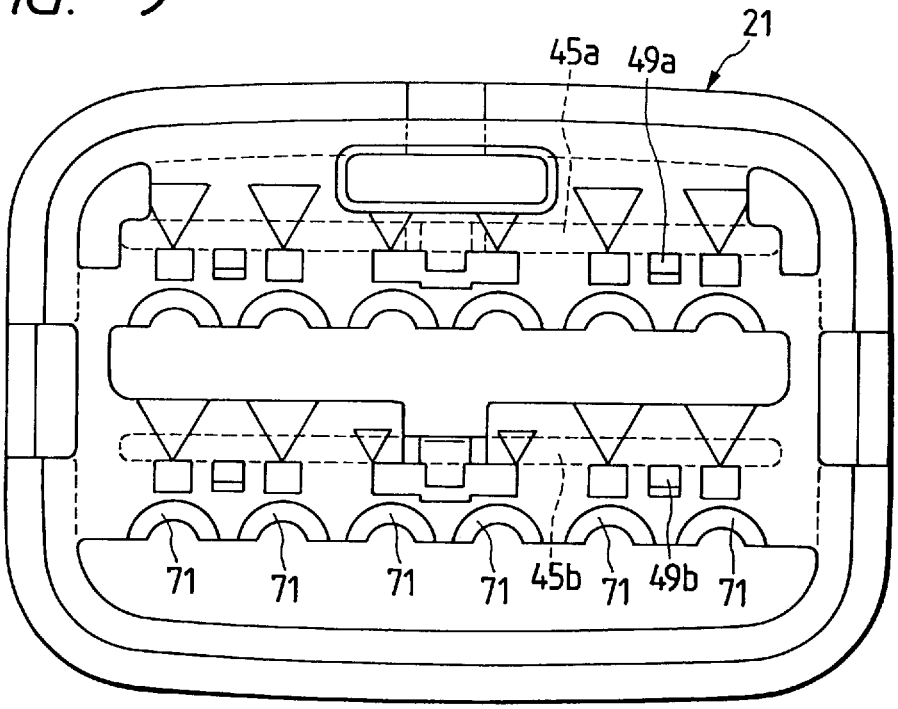
FIG. 9 is a front view of a front holder.
Figure 17:
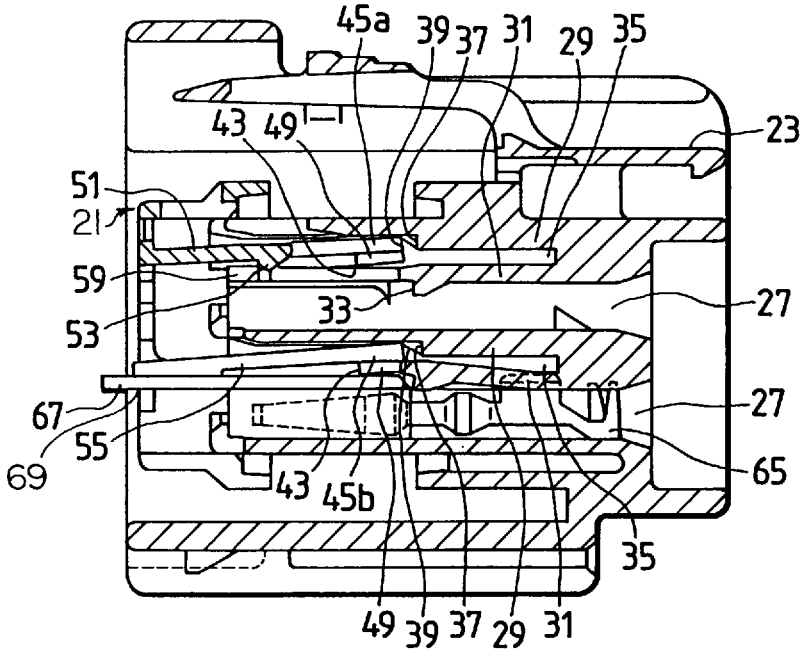
FIG. 17 is a cross-sectional view of the front holder assembled to the housing in a provisional engagement position with a jig used for drawing a terminal being inserted into the terminal receiving chamber.

The main body 47 of the front holder 21 is formed with a plurality of windows 69 for a jig 67 used for drawing out a terminal, as shown in FIG. 17. It is possible to insert the jig 67 into the terminal receiving chambers 27 with the front holder 21 being secured to the housing 23. In addition, there is formed a taper 71 below the windows 69, as shown in FIGS. 3, 9 and 15. A mating male terminal to be connected with a female terminal 65 inserted into the terminal receiving chambers 27 is guided into the terminal receiving chambers 27 by the taper 71.

Hereinbelow will be explained steps of assembling the front holder 21 to the housing 23 with reference to FIGS. 14 to 17. As illustrated in FIG. 14, the half-insertion detectors 45*a* and 45*b* of the front holder 21 are inserted into the terminal receiving chambers 27 through the front of the housing 23. If the front holder 21 is provisionally assembled to the housing 23, the provisional engagement projection 53 are engaged to the projection 59 to thereby avoid the front holder 21 from being taken off the housing 23, and the final engagement projection 57 abuts against the projection 61 to thereby prevent the front holder 21 from entering the housing 23, thus maintaining the front holder in provisional engagement with the housing. The raised portions 49*a* and 49*b* of the half-insertion detectors 45*a* and 45*b* are pushed up towards the abutment surface 37 by the push-up projections 43, and thus the driving portions 63 are not in abutment with the inclined surface 39. In this state, the distal ends of the half-insertion detectors 45*a* and 45*b* do not face end surfaces of the engagement arms 31, and the engagement arms 31 lap the half-insertion detectors 45*a* and 45*b*. Namely, the half-insertion detectors 45*a* and 45*b* extend into the deformation space 35 relative to the distal ends of the engagement arms 31 by a lap distance Y. In addition, if the metal terminals 65 are inserted into the terminal receiving chambers 27 in such a state, there is formed a clearance X between the half-insertion detectors 45*a* and 45*b* and the engagement arms 31. In this state, it is impossible to transfer the front holder 21 into full engagement with the housing. By further inserting the metal terminals 65, the stepped portions 33 of the engagement arms 31 come to engagement with the metal terminals 65, and thus the half-insertion detectors 45*a* and 45*b* of the front holder 21 are now able to be inserted into the deformation space 35.

Then, the lock arm 55 is upwardly deformed, and the front holder 21 is pushed so that the final engagement projection 57 is located above the projection 61 to thereby insert the half-insertion detectors 45*a* and 45*b* into the terminal receiving chambers 27. Thus, the driving portions 63 come to abutment with the inclined surface 39 and, as shown in FIG. 15, thereby are guided into the deformation space 35. The final engagement projection 57 is engaged with the projection 61, the front holder 21 thereby being assembled into the housing 23 at the final engagement position.

Figure 16:
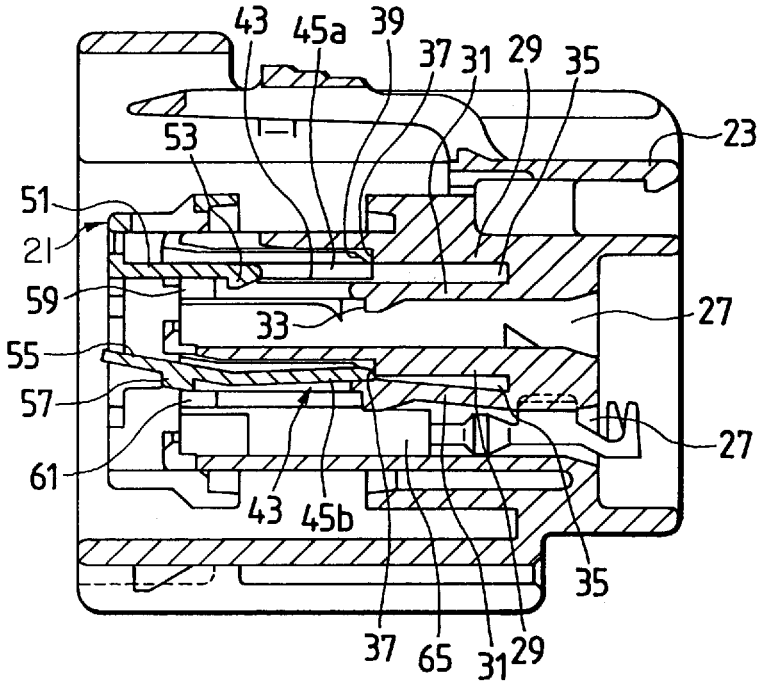
FIG. 16 is a cross-sectional view of the front holder assembled to the housing in a provisional engagement position with a metal terminal being half-inserted into a terminal receiving chamber.

As illustrated in FIG. 16, when the metal terminals 65 are half-inserted into the terminal receiving chambers 27, the engagement arms 31 are deformed in the deformation space 35. If the front holder 21 is inserted into the terminal receiving chambers 27 with the engagement arms being deformed, the half-insertion detectors 45*a* and 45*b* attempt to enter the deformation space 35 by the driving portions 63 being guided by the inclined surface 39. However, since the engagement arms 31 are in deformation, if the front holder 21 is further pushed into the terminal receiving chambers 27, sliding on backs 100 of the engagement arms 31, the distal ends of the half-insertion detectors 45*a* and 45*b* abut against the abutment surface 37. Thus, the pushing force acts on the abutment surface 37. However, since the abutment surface 37 is made of a rigid material, the abutment surface is never damaged. In addition, the engagement arms 31 are not damaged, either. Thus, the front holder 21 cannot move to the final engagement position, and hence it is possible to detect that the metal terminals 65 are half-inserted into the terminal receiving chambers 27.

As illustrated in FIG. 17, the front holder 21 is formed with windows 69 through which is to be inserted the jig 67 used for drawing out a terminal. In the provisional engagement between the front holder 21 and the housing 23, the half-insertion detectors 45*a* and 45*b* are deformed towards the abutment surface 37, since the half-insertion detectors 45*a* and 45*b* are in abutment with the raised portions 49 and the push-up projections 43 of the housing 23. Hence, it is possible to insert the jig 67 into the terminal receiving chambers 27, and draw the metal terminals 65 out of the terminal receiving chambers 27 without taking the front holder 21 off the housing 23. For removing the metal terminals 65, there is needed only a force for deforming the engagement arms 31, because there exists the clearance X between the half-insertion detectors 45*a* and 45*b* and the engagement arms 31 when the engagement arms 31 are made to be deformed in the deformation space 35 by the jig 67. Accordingly, the metal terminals 65 can be readily removed from the housing 23. In addition, once the front holder 21 is assembled to the housing 23, the front holder 21 is never taken off the housing 23, and hence the front holder 21 is never lost.

Furthermore, the provision of the taper 71 below the windows 69 ensures smooth insertion of a mating male terminal into the terminal receiving chambers 27.

As described in connection with the preferred embodiment, the invention provides the following advantages.

When the front holder is inserted into the terminal receiving chambers with a metal terminal being half-inserted into the terminal receiving chamber, the half-insertion detector of the front holder is deformed towards the abutment surface by the abutment surface guide means. If the metal terminal is half-inserted into the terminal receiving chamber, it is not possible to insert the half-insertion detector into the deformation space. Thus, if the front holder is further pushed into the terminal receiving chambers, the front end of the half-insertion detector abuts against the abutment surface. Accordingly, it is possible to positively detect that metal terminals are half-inserted into the terminal receiving chambers, and the half-insertion detector never abuts against the distal end of the engagement arms, so the engagement arms are not damaged.

What is claimed is:

1. A mechanism for detecting whether a metal terminal is half-inserted into a connector, said mechanism comprising:

a housing including a terminal receiving chamber into which a metal terminal is to be inserted; a flexible engagement arm projecting into said terminal receiving chamber for engaging the metal terminal inserted into said terminal receiving chamber to thereby prevent disengagement of the metal terminal from said terminal receiving chamber; and a wall defining, in conjunction with said engagement arm, a deformation space, said engagement arm being deformable into said deformation space;

a front holder, insertable into the deformation space from a front of said housing so as to prevent the metal terminal from being disengaged from said terminal receiving chamber, and having a half-insertion detector for detecting half-insertion of the metal terminal into said terminal receiving chamber;

said wall including an abutment surface which said half-insertion detector abuts when the metal terminal is half-inserted into said terminal receiving chamber, said abutment surface being located rearward of a free end of said engagement arm; and abutment surface guide means for deforming said half-insertion detector towards said abutment surface.

2. The mechanism as set forth in claim 1, further comprising deformation space guide means for guiding into the deformation space said half-insertion detector deformed towards said abutment surface by said abutment surface guide means when the metal terminal is full-inserted into said terminal receiving chamber.

3. The mechanism as set forth in claim 1 or 2, wherein said abutment surface guide means includes a push-up projection disposed on said housing, and a raised portion disposed at a distal end of said half-insertion detector and slidable on said push-up projection to deform said half-insertion detector towards said abutment surface.

4. The mechanism as set forth in claim 2, wherein said deformation space guide means includes an inclined guide surface formed with said housing, and a driving portion located at a distal end of said half-insertion detector and slidable on said inclined guide surface.

5. The mechanism as set forth in claim 1, 2 or 4, further comprising provisional engagement means for provisionally engaging said front holder to said housing at a provisional engagement position at which said half-insertion detector of said front holder is not inserted in the deformation space, and final engagement means for finally engaging said front holder to said housing at a final engagement position at which said half-insertion detector is inserted into the deformation space.

6. The mechanism as set forth in claim 3, further comprising provisional engagement means for provisionally engaging said front holder to said housing at a provisional engagement position at which said half-insertion detector of said front holder is not inserted in the deformation space, and final engagement means for finally engaging said front holder to said housing at a final engagement position at which said half-insertion detector is inserted into the deformation space.

7. The mechanism as set forth in claim 5, wherein said front holder further comprises a window for insertion of a jig used for removing a terminal, said window disposed between said half-insertion detector and a tapered surface for guiding a male terminal, said jig deforming only said engagement arm in the deformation space when said front holder and said housing are at the provisional engagement position.

8. The mechanism as set forth in claim 6, wherein said front holder further comprises a window for insertion of a jig used for removing a terminal, said window disposed between said half-insertion detector and a tapered surface for guiding a male terminal, said jig deforming only said engagement arm in the deformation space when said front holder and said housing are at the provisional engagement position.

* * * * *